United States Patent [19]

Fox

[11] Patent Number: 4,760,930

[45] Date of Patent: Aug. 2, 1988

[54] SHELVING COMPONENT

[75] Inventor: Clifford R. Fox, Chelmsford, England

[73] Assignee: CBM Display Group Limited, Hainault, England

[21] Appl. No.: 51,229

[22] Filed: May 12, 1987

[30] Foreign Application Priority Data

May 13, 1986 [GB] United Kingdom ..... 8611620

[51] Int. Cl.[4] ..... A47F 5/00

[52] U.S. Cl. ..... 211/153; 248/250

[58] Field of Search ..... 248/250, 241, 242, 243, 248/247, 235; 211/79, 153, 186, 187, 90; 108/159, 110

[56] References Cited

U.S. PATENT DOCUMENTS

| | | | |
|---|---|---|---|
| 2,441,669 | 5/1948 | Giambalvo | 248/250 X |
| 3,912,210 | 10/1975 | Von Bohr | 108/159 X |
| 3,966,159 | 6/1976 | Brown | 248/250 |
| 4,508,301 | 4/1985 | Nicholson et al. | 248/250 |
| 4,658,969 | 4/1987 | Mastrodicasa | 248/250 X |
| 4,685,575 | 8/1987 | Kulbersh | 211/90 |

*Primary Examiner*—Ramon O. Ramirez

*Attorney, Agent, or Firm*—Berman, Aisenberg & Platt

[57] ABSTRACT

A single piece synthetic plastics extruded shelving component, for use in the display, storage or sale of goods. The component has a flat elongate part which provides a shelf surface when in use. It also has a portion that extends along one side of the elongate part, is thicker than that part and is integral therewith, and provides means such as a groove for supporting a further shelving part, such as a riser.

8 Claims, 4 Drawing Sheets

SHELVING COMPONENT

The present invention relates to a shelving component for use in supermarkets and other stores for the support of goods which are being displayed, or which are for sale, or which are simply being stored.

One prior construction of such a component comprises a steel superstructure over-layed with a thin hardboard or plastics covering usually about 3 to 6 mm in thickness. It is generally difficult to provide on such a component a ticket channel or riser on a front leading edge of the component without the additional expense of connecting a further component to that edge, such as a PVC or aluminum extrusion which may be clipped on to or riveted to the shelving component.

Another form of shelving component already proposed is a simple slat. However, if this is to be provided with means for attaching a riser to the leading front edge, or if it is to be provided with a ticket channel on that edge, it is necessary either for the slat to be so thick that it is unacceptably bulky and heavy, or else for a thicker part to be added to the front edge, which again adds to the cost of the finished component and to the time that it takes to make it.

The present invention seeks to provide a remedy.

Accordingly the present invention is directed to a single piece synthetic plastics extruded shelving component, for use in the display, storage or sale of goods, comprising a flat elongate part which provides a shelf surface when in use, and a portion that (a) extends along one side of the elongate part, (b) is thicker than that part, (c) is integral therewith, and (d) provides a means for supporting a further shelving part.

The means for supporting a further shelving part may comprise at least one groove in the thicker portion which can be engaged by a corresponding male edge portion of a riser.

Alternatively or in addition, the thickened portion may provide a ticket channel along the edge of the shelving component.

An intended underside of the shelving component may have at least one integral downwardly projecting portion to enable the component to engage a support frame. Preferably, channels are defined by such downwardly projecting portions which extend along the extrusion and which are adapted to receive horizontal bars of such a frame.

Examples of a shelving component made in accordance with the present invention are illustrated in the accompanying diagrammatic drawings in which.

Figure 11:
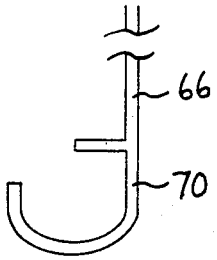
Figure 9:
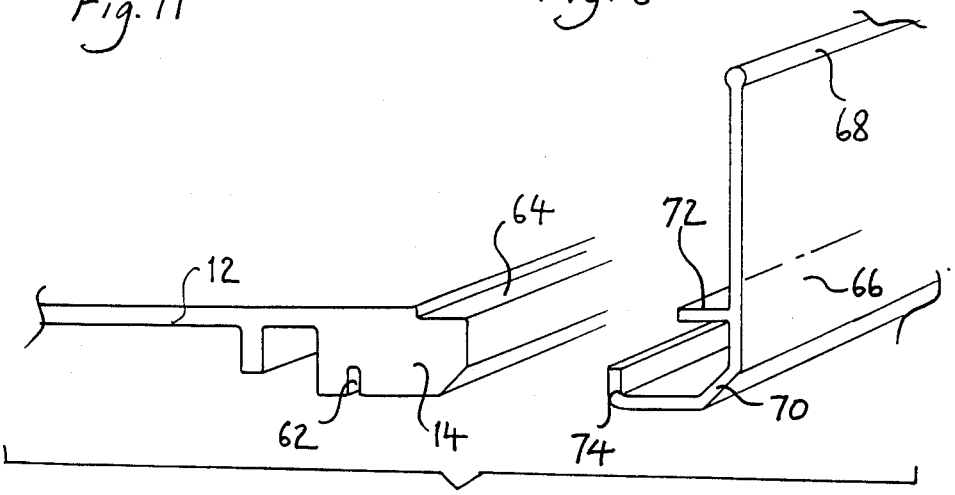
Figure 10:
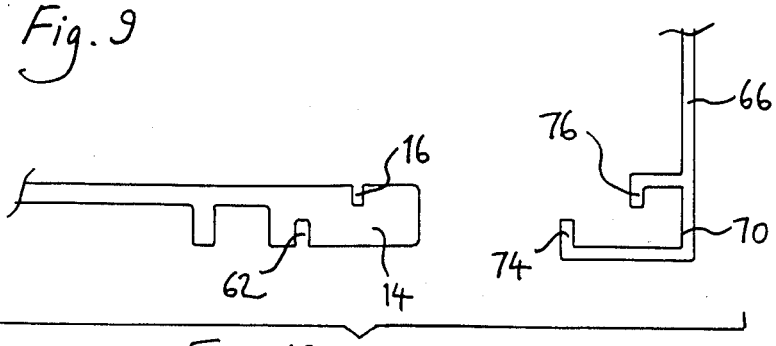

FIGS. 9 and 10 also show cross-sections of corresponding risers for the shelving components shown in those Figures; and FIG. 11 shows a cross-section of a lower end of a modified riser.

Figure 1:
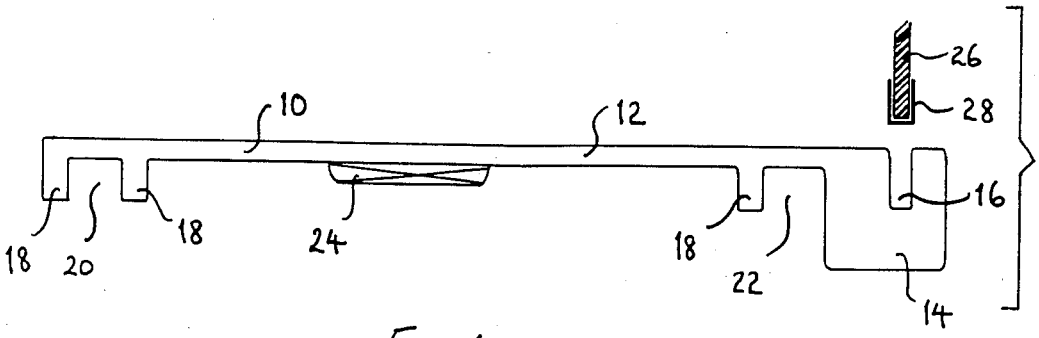
FIG. 1 shows a cross-sectional view of such a shelving component.
Figure 2:
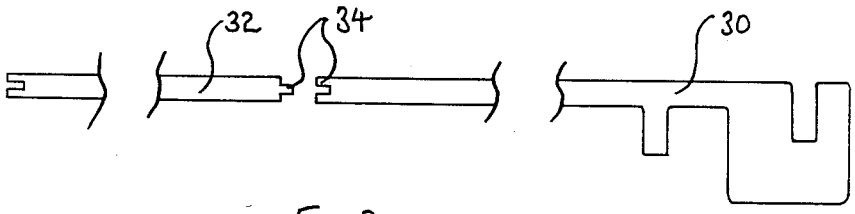
FIG. 2 shows a part cross-sectional view of a shelving assembly which includes a modified shelving component.

The shelving component 10 shown in FIG. 1 is made of Lignum (Trade Mark). This is a polystyrene plastics material in to which very fine bubbles of air have been forced to give the plastics material a relative density of substantially in the region 0.65 to 0.8. This material is extruded through a die to provide an elongate shelving component having the cross-section shown in FIG. 1. Thus the component 10 is a single piece synthetic plastics extruded shelf component. It comprises a flat elongate part 12 (extending perpendicularly to the plane of the cross-section shown in FIG. 1), which may be, say, 3 mm to 12 mm thick. This flat part provides a shelf surface when the component is in use. The component 10 also has a thickened generally square-sectioned portion 14 extending along an intended front edge of the component. The thickened portion 14 may be, say, 15 mm to 40 mm thick, and is provided with a slot, groove, or recess 16 which extends downwardly from an intended upper side of the component and is roughly 6 mm wide. Three downwardly projecting portions 18 are provided on the under side of the shelf component 10. These all extended along the component because they are an integral part of the extrusion. Two of them are close to one another adjacent to a rear edge of the component 10, which defines a rear channel 20. The third is close to the thickened portion 14 and defines therewith a forward channel 22. The channels may be, say, 10 mm to 30 mm wide. Lastly, a central reinforcing rib 24 may be provided on the underside of the flat elongate part 12. This rib 24 may be, say, 15 mm to 150 mm wide. All the foregoing features of the component 10 are formed as an integral part of the extrusion by virture of the profile of the die construction.

A simple extruded sheet of plastics material, preferably transparent, may form a riser 26 which can be inserted into the groove or recess 16. A tight fit between the riser and the groove 16 may be obtained by means of U-sectioned rubber gasket 28. When in place, the riser 26 inhibits goods from sliding off the front edge of the shelving component.

A modified form of shelving component 30 is shown in which at least one additional section 32 can be attached to the main component 30 by means of a tongue and groove connection 34, to extend the width of the flat elongate part beyond a maximum of about 300 mm which present day extruding machines are capable of. Instead of a tongue and groove connection, a hook-over connection (not shown) would be possible.

Figure 3:
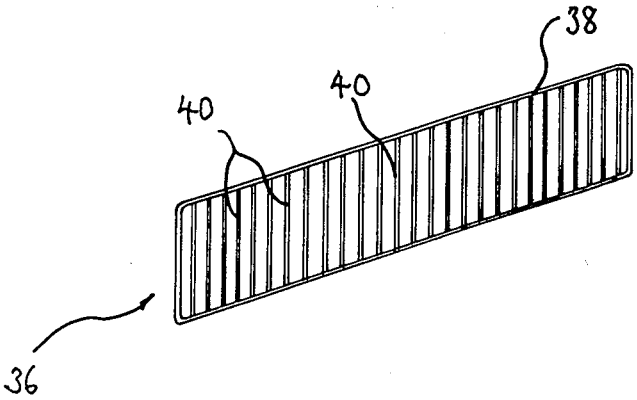
FIG. 3 shows a perspective view of a rise for use with a shelving component as shown in FIG. 1 or 2.

FIG. 3 shows an alternative form of riser to the one shown in FIG. 1. Thus FIG. 3 shows a wire rieser 36 comprising an elongate rectangular frame 38 which is approximately 6" high and which is provided with a grille of upright wire lengths 40 along its whole length.

Figure 4:
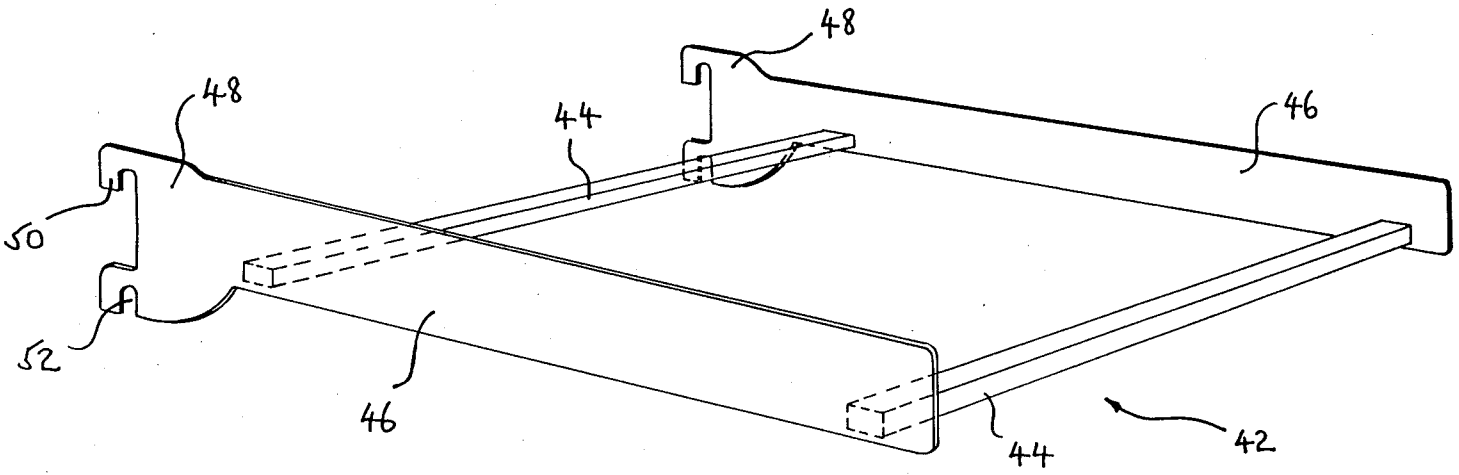
FIG. 4 shows a perspective view of a support frame for supporting a shelving component as shown in FIGS. 1 or 2.
Figure 5:
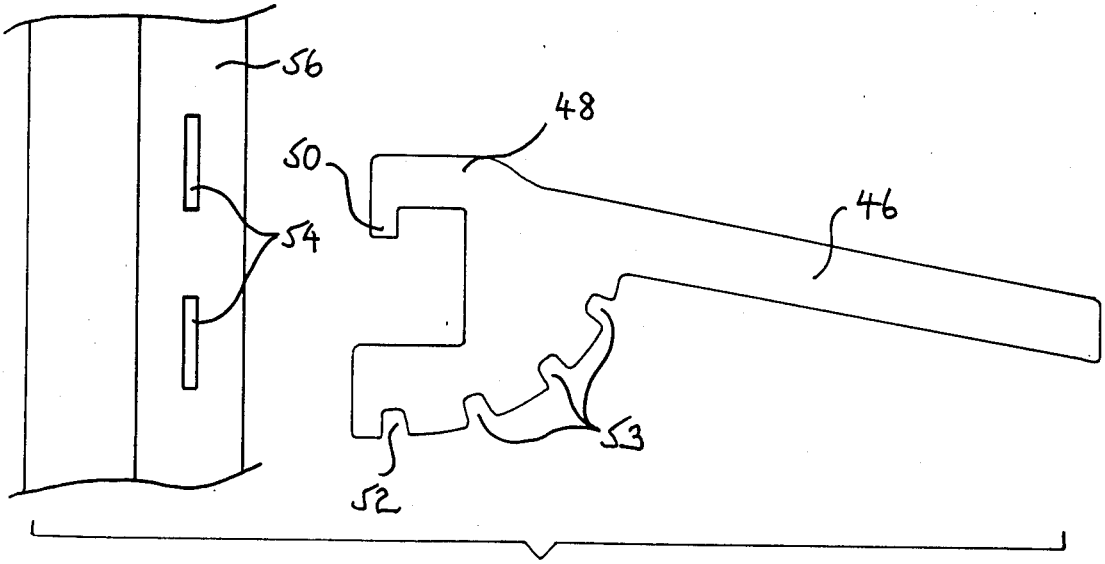
FIG. 5 shows a perspective view of a device by which the frame shown in FIG. 4 can be supported on upright support stems.

The frame 42 shown in FIG. 4 comprises two horizontal square-tube section or channel section bars 44 spaced apart in a generally horizontal plane and fixed parallel to one another and spaced apart from one another by two sheet metal side arms 46 to which the bars 44 are welded or otherwise secured. Each support arm is provided with a forked rear bracket 48 which has an upper down-turned hook portion 50 on the upper part of the fork and an upwardly extending lower notch 52 in the lower part of the fork. The hook portion 50 and the lower notch 52 may engage respective adjacent upright slots 54 in an upright hollow square sectioned support stem 56 shown in FIG. 5. To this end the upper and lower parts of the fork and the bracket 48 are inserted into the adjacent slots 54 and then the whole frame 42 is lowered so that the hook portion 50 engages the stem 56 just below and rearwardly of the upper slot 54, and the notch 52 sits on the bottom edge of the lower slot 54. In FIG. 5, a number of further notches 53 are provided spaced apart around an arcuate outer periphery of the lower portion of the fork. This enables the frame 42 to be supported on two stems 56 at any selected one of a number of different possible downward inclinations.

The length of the frame 42 may be say from 300 mm to 1500 mm.

With a support frame 22 held in position in this way on two upright support stems interconnected by horizontal tie tubes (not shown), a shelving component as shown in FIG. 1 may be rested on the frame in such a manner that the two channels 20 and 22 of the component receive the two bars 44.

Figure 6:
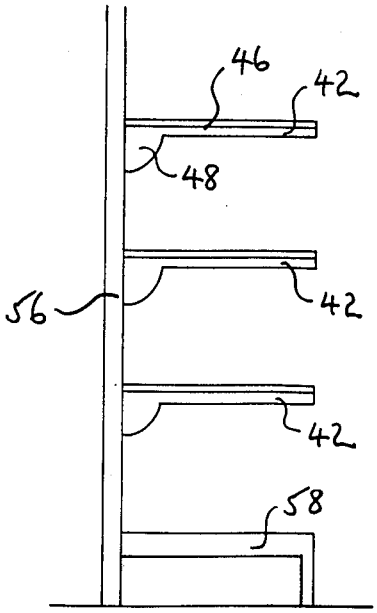
FIG. 6 shows a side view of a completed assembly of components shown in FIG. 1, FIG. 4, and FIG. 5.

A side view of the complete assembly is shown in FIG. 6, in which only one of the two upright stems 56 is visible. The assembly is further provided with a stabilising base 58.

Figure 7:
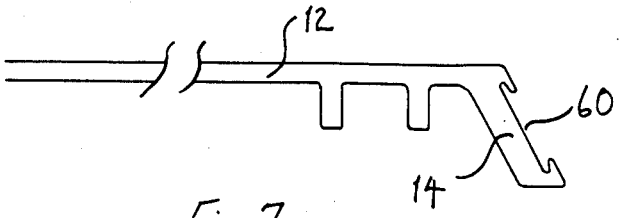
FIGS. 7 to 10 show respective cross-sections through the front ends of modified shelving components.
Figure 8:
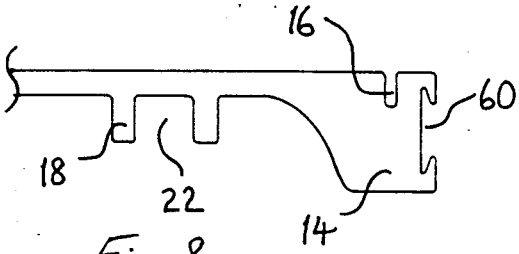

Numerous modifications to the shelving component are possible without taking the component outside the scope of the present invention. In FIG. 7, for example, the thickened portion 14 slants outwardly and downwardly and is provided with a slanting upwardly directed ticket channel 60 which is formed as part of the extrusion. In FIG. 8, the front channel 22 is defined between a pair of outwardly extending projections 18 in the same manner as the rear channel 20 (not shown in FIG. 8), and a ticket channel 60 is provided in the thickened portion 14 in addition to the groove or recess 16. In FIG. 9, instead of a downwardly extending groove 16, the thickened portion 14 has a groove or recess 62 extending upwardly from the underside of the thickened portion 14. The front edge of the thickened portion 14 is shaped to give it a neat appearance, with the lower corner chamfered. It includes a cut-away 64 from the upper edge of the thickened portion 14. Although referred to as a cut-away, it is in fact formed during extrusion by virtue of the die construction. An extruded riser 66 has a widened and rounded edge 68 to strengthen it, and along its lower edge, a channel section 70 which conforms to the front edge of the thickened portion 14 of the shelving component, and includes a horizontal rearwardly projecting portion 72 which is accommodated by the cut-away 64 of the shelving component, and an upturned lip 74 which is received by the groove or recess 62. Thus the riser 66 can be threaded on to the thickened portion 44 by its channel 70 and slid along until its edges are in registration with those of the shelving component. FIG. 10 shows a further modification to the thickened portion 14 which also has a groove or recess 16 in the upper side of the thickened portion 14 to receive a down-turned lip 76 of the riser 66. Also, in FIG. 10, the channel 70 is generally rectangular in shape, without the chamfering.

FIG. 11 shows a modified form of riser 66 in which the channel 70 is more rounded.

It is to be understood that the present invention is in no way limited by the particular embodiments illustrated in the drawings, and that numerous variations and modifications to the illustrated shelving components are possible wihtout taking them outside the scope of the present invention. The thickened portion 14 may be formed with a ticket channel along its front side instead of the groove or recess 16 so that the shelving component is adapted to receive a ticket or tickets along its front, instead of a riser. Although Lignum (Trade Mark) has been given as a suitable plastics material for extruding the shelving, it will be appreciated that any other material which provides a rigid structure when extruded may be used.

It will be further appreciated that the shelving component shown in FIG. 1 is made completely by one extrusion process without the need for any further machining, and may be cut to any desired length, the maximum extruded length being in the order of 4 meters.

Fire retardent materials may be added to the material prior to extrusion.

Wood grains and a whole variety of colours are possible for the shelving component.

I claim:

1. For use in the display, storage or sale of goods, a single piece synthetic plastics extruded shelving component comprising a flat elongate part which provides a shelf surface when in use, and a portion that (a) extends along the elongate part, at a front thereof, (b) is thicker than that part, (c) is integral therewith, and (d) provides means which extends along the extrusion and which serves to support a further shelving part when the component is in use.

2. A component according to claim 1, in which the said means which serve to support a further shelving part comprise at least one groove in an upper surface of the thicker portion, which groove can be engaged by a corresponding male edge portion of a rise when the component is in use.

3. A component according to claim 1, in which the thicker portion is provided with a ticket channel along an outwardly facing surface of the thicker portion.

4. A component according to calim 1, in which an intended underside of the shelving component has at least one integral downwardly projecting portion to enable the component to be retained on a support frame when the component is in use.

5. A component according to claim 4, in which two channels are defined by such downwardly projecting portions, which channels extend along the extrusion and which are adapted to receive horizontal bars of such a frame.

6. For use in the display, storage or sale of goods, a shelving assembly comprising :

(a) upright support means;
(b) a support frame;
(c) attachment means by which said support frame is attached to said upright support means;
(d) two substantially parallel bars of said support frame which are substantially horizontal when the assembly is in use;
(e) at least one single piece synthetics plastics extruded shelving component;
(f) a flat elongate part of said at least one component which provides a shelf surface when in use;
(g) a thicker portion of said at least one component which extends along said elongate part at a front thereof, is thicker than that part and is integral therewith;
(h) means, provided by said thicker portion, which serves to support a further shelving part when the component is in use;

(i) an underside of said at least one shelving component;

(j) integral downwardly projecting portions on said underside of said at least one shelving component defining two channels which extend along the extrusion and which receive said two substantially parallel bars.

7. An assembly according to claim 6, in which said means which serves to support a further shelving component comprises at least one groove in an upper surface of said thickened portion, and the assembly further comprises a riser having a lower edge received in said at least one groove.

8. An assembly according to claim 6, in which said thicker portion is provided with a ticket channel along an outwardly facing surface of the thicker portion.

* * * * *